US005553547A

United States Patent [19]

Miller

[11] Patent Number: 5,553,547

[45] Date of Patent: Sep. 10, 1996

[54] LASER CONTROLLED INDEXER FOR PRINTING ON WARE

[75] Inventor: William J. Miller, Forest Hills, Pa.

[73] Assignee: Miller Process Coating Co., East Pittsburgh, Pa.

[21] Appl. No.: 488,703

[22] Filed: Jun. 6, 1995

[51] Int. Cl.[6] ..... B41F 1/34

[52] U.S. Cl. ..... 101/485; 101/114; 101/118; 101/129; 101/38.1

[58] Field of Search ..... 101/485, 486, 101/114, 115, 116, 117, 118, 129, 38.1, 39, 40, 40.1

[56] References Cited

U.S. PATENT DOCUMENTS

| | | | |
|---|---|---|---|
| 4,712,474 | 12/1987 | Motev | 101/129 |
| 5,142,975 | 9/1992 | Podalsky et al. | 101/129 |
| 5,226,366 | 7/1993 | Schlife et al. | 101/485 |
| 5,252,838 | 10/1993 | Timblin | 61/115 |
| 5,301,608 | 4/1994 | Szarka et al. | 101/129 |
| 5,419,213 | 5/1995 | Karlyn et al. | 101/38.1 |

FOREIGN PATENT DOCUMENTS

| | | | |
|---|---|---|---|
| 403061573 | 3/1991 | Japan | 101/485 |

*Primary Examiner*—Eugene H. Eickholt
*Attorney, Agent, or Firm*—Clifford A. Poff

[57] ABSTRACT

A laser generator and a receiver are used to transmit and receive a laser beam for reflection by the leading edge of existing printing on ware to establish an indexing reference for printing to be newly applied to the ware. The receiver provides an electrical signal to disconnect drive motor from a drive train and engage a non-operating screen drive train to stop rotation of the ware. After indexing has been accomplished, the printing cycle is initiated causing silk screen to reciprocate in a synchronous speed with rotation of the ware while a squeegee establishes line contact with a screen to force printing medium through open spaces on the screen onto the ware.

15 Claims, 6 Drawing Sheets

LASER CONTROLLED INDEXER FOR PRINTING ON WARE

BACKGROUND OF THE INVENTION

1. Field of the Invention

The present invention relates to a method and apparatus for indexing ware to receive printing, and, more particularly, to a laser generator means to direct a laser beam on the surface of a rotating ware for generating an electrical signal upon detection of the beam by a detector at a predetermined indexing reference site to initiate a printing process in an area defined relative to the reference site.

2. Description of the Prior Art

Semi-automatic cylindrical printers are known in the art and take the form of a silk screen assembly that is reciprocated back-and-forth by a drive between a squeegee and a ware while the ware rotates in synchronism with the reciprocating screen through an interconnecting rack and pinion drive. If desired, the ware can be rotated solely by the contact with the moving silk screen. The squeegee is moved to establish line contact between the screen and the surface of the ware so that ink or other printing medium is forced by the squeegee through open spaces on the screen onto the ware. In this type of semi-automatic cylindrical printer the ware is loaded by a workman onto a holding fixture that can be vacuum operated or mechanically operated to establish a driving relation between the holder and the ware. The ware which can receive printing in this manner varies greatly and typically includes cylindrical items such as cosmetic bottles, pens, baseball bats, hats, aerosol cans and glass tumblers. Certain of these workpieces because of their configuration and material of construction, such as glass tumblers, which are cylindrical with a flat bottom, present problems which the present invention is designed to overcome when undertaking the printing on the cylindrical surface.

The blow molding process used to produce the glass tumbler presents ever changing variables from glass tumbler to glass tumbler including surface irregularities at the site where the tumbler is supported by the holder as well as along the entire cylindrical wall surface. In decorating machines using silk screen printing techniques for multiple colors, each color must be applied by a separate printing operation, thus necessitates a registration procedure between the existing printing and printing to be newly applied. Separate printing machines can be used for each one of the various colors or one or more printing machines can be used with a given set of silk screens being replaced at the completion of the printing on a select number of workpieces with all the screens being ultimately used to print all the required colors.

After the first color is printed, it is necessary to establish a desired position of the ware so that the site on the ware for colors to be subsequently printed will register properly with the existing printing. For this purpose it is necessary that the area on the ware to receive printing arrives at the site of the squeegee at the same time the open spaces in the screen are advanced across the squeegee to affect the printing operation. To accomplish such registration, it is known in the art to use a stylus, needle or similar pointed indicator mounted by a holder on the frame of the printer to identify the reference site on ware for establishing registration with indicia just prior to a the printing operation on the ware.

Because of the nature of the printing operation, the site where printing occurs being at the junction of the screen, squeegee and ware, it is not possible to use a pointing indicator at this site, thus the indicator must be used to locate a remote site as a point of reference. It is always necessary to establish registration in multiple color printing operations where an initial printing occurs in single stage printing machines is used to establish registration with a subsequent printing or printings.

The use of a pointed indicator presents certain problems to the establishment of registration of successive printings on ware which the present invention is designed to overcome. The holder drive for the ware must be jogged or hand manipulated into the position to establish registration with the pointer indicator. Such a registration procedure is time consuming and heretofore has a significant adverse affect to the printing cycle time. Moreover, the accuracy of registration is completely operator dependent and usually the accuracy achieved is within a tolerance of plus or minus three thirty seconds of an inch.

An attempt to improve the registration process was to replace the pointer indicator with an infrared light source and a detector. Erratic, random results were found when the color of the printing of the ware did not contrast sufficiently to produce a differential to the reflection which was necessary to trigger the response by the detector. In other instances, distortions to the infrared light due to dimensional changes to the material of the ware, which are always inherent with plastic, ceramic and vitreous materials. Even when the infrared light was detected, for the printing on one ware, there could be no assurances that the infrared detector could be relied upon to give faithful results for subsequent printing on the same or other ware. Irregularities to the surface configuration of the cylindrical part on the ware were also found to give irregular and inaccurate registration signals because the reflected infrared light energy is dispersed by the surface of the ware. Moreover, the use of infrared light source and detector necessitated a very close proximal relation between the source and the ware and the detector and the ware. As a result, the infrared source and the detector are prone to damage impact with the ware due to rotation of an out-of-round condition to the ware and during loading and unloading of the ware for the printing operation.

The loss of production is seriously affected when the misprinting of one color occurs. Usually all existing printings must be removed because it is impossible to remove only the misprinted pattern without the simultaneous removal of all colors. This condition is encountered with all printings irrespective of the ingredient used in the paint to solidify the paint after printing. This condition can be avoided by firing after each printing but substantial costs are added and can be avoided by the present invention.

Accordingly, it is an object of the present invention to provide an improved semi-automatic printing through the use of a laser beam generator and detector to accomplish registration of the ware relative to indicia on the silk screen for printing on the ware.

It is a further object of the present invention to use a laser beam and detector to avoid the short comings and disadvantages arising out of the use of known indicators for accomplishing registration of ware incident to a printing operation.

SUMMARY OF THE INVENTION

More particularly according to the present invention there is provided an apparatus for indexing ware to receive printing, the apparatus including the combination of a holder for supporting ware for rotation about an axis, means for supporting ware along the axis at a predetermined indexing reference site, means for rotating the holder about the axis, a laser including means for directing a laser beam generated thereby toward a surface of ware while rotated by the holder, a laser detector responsive to reflection of laser radiation incident on a predetermined indexing reference site on the ware, and control means outputing an electrical control signal in response to laser radiation incident on the laser detector for initiating printing on the ware at a predetermined printing area defined relative to the indexing reference site.

According to another aspect of the present invention there is provided a method to index ware for printing thereon, the method including the steps of supporting the ware at an indexing plane for rotation about an axis perpendicular to the indexing plane, establishing an indexing reference site on the ware, directing a laser beam on the ware for intersection by the indexing reference site during rotation of the ware about the axis, arranging a detector to respond to laser radiation incident on the indexing reference site, generating an electrical signal in response to laser radiation incident on the detector while rotating the ware about the axis, and applying printing to the ware in response to the electrical signal.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
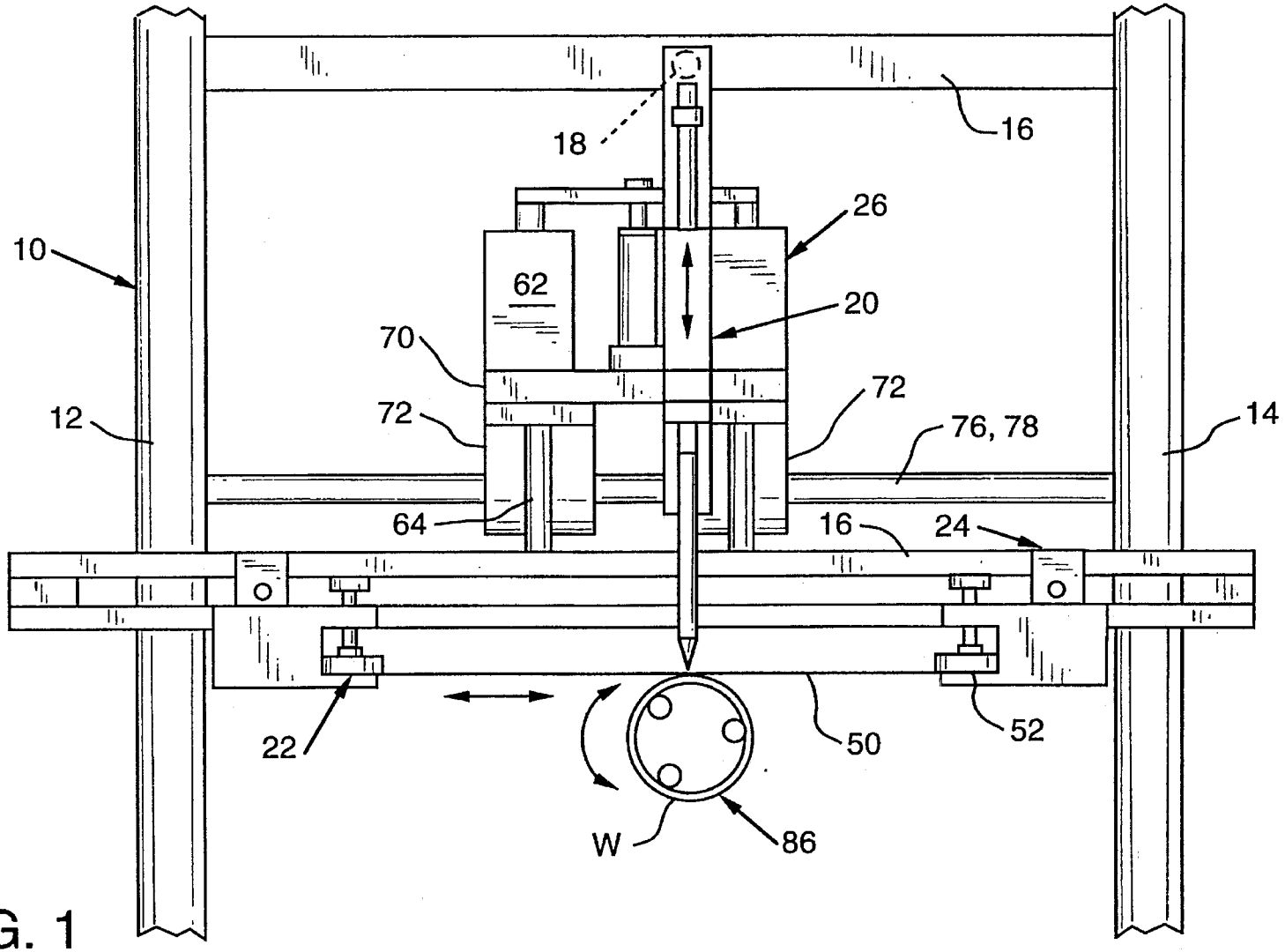
FIG. 1 is a front elevational view illustrating the screen and squeegee drives relative to ware on a holder for printing operation according to the present invention.
Figure 2:
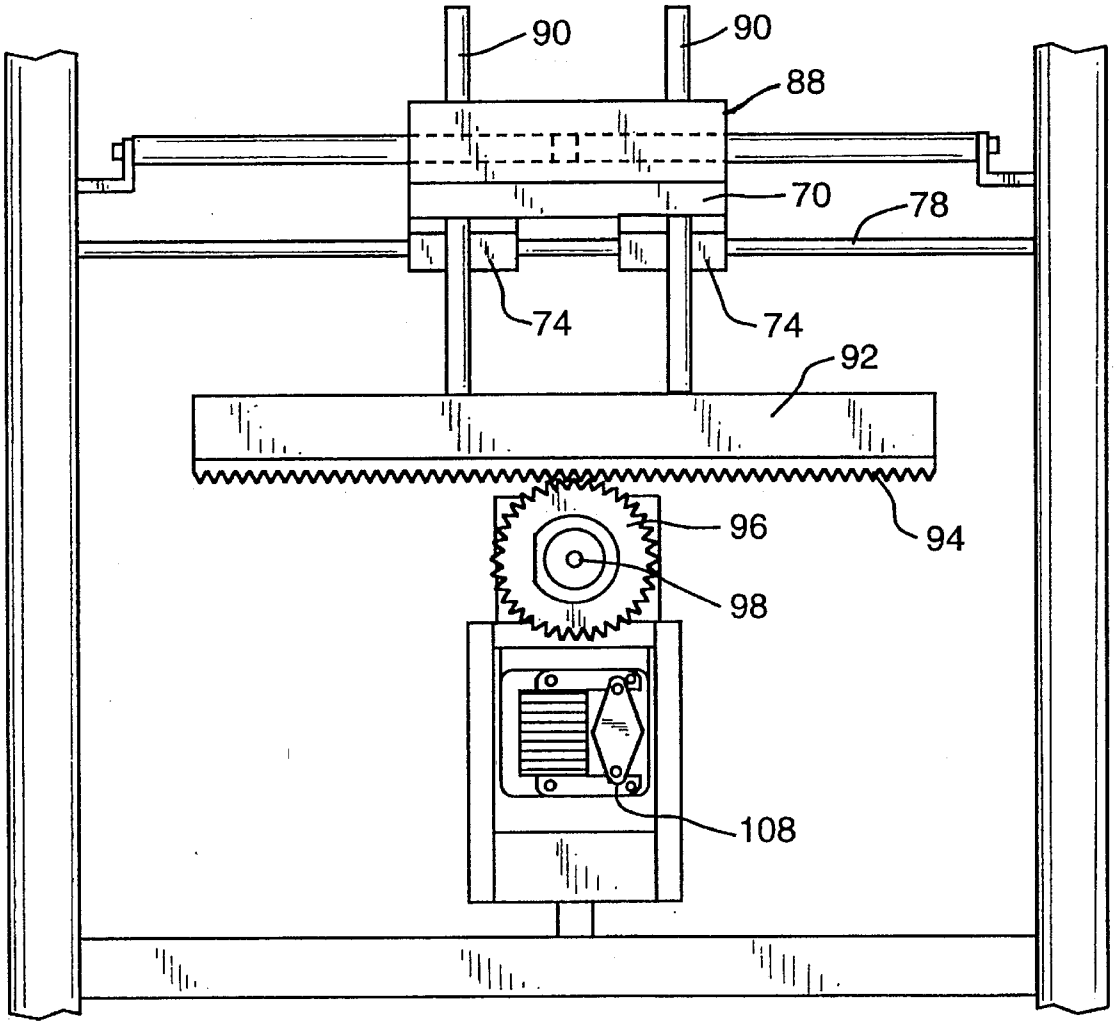
FIG. 2 is a rear elevational view showing the rack and pinion drive interconnection between the screen and squeegee and the holder.

In FIGS. 1 and 2 there is illustrated a frame for a printing machine 10 that includes spaced apart upstanding side walls 12 and 14 that are joined together at their upper ends by a top wall 16. The top wall carries a robust support 18 which carries a squeegee assembly 20. A silk screen assembly 22 is supported by a frame 24 which is vertically reciprocated by a screen positioning drive 26 and horizontally reciprocated along parallel slide rods 76 and 78 by a drive, as will be described in greater detail hereinafter.

Figure 1A:
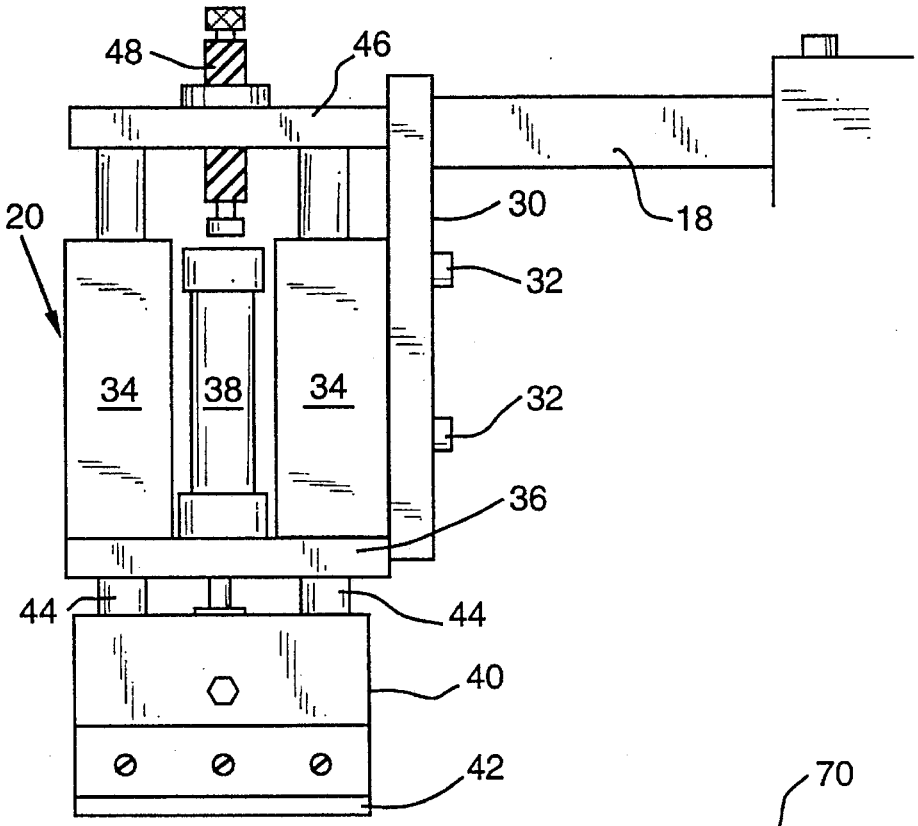
FIG. 1A is a detailed isometric illustration of squeegee support drive and mechanism.
Figure 1B:
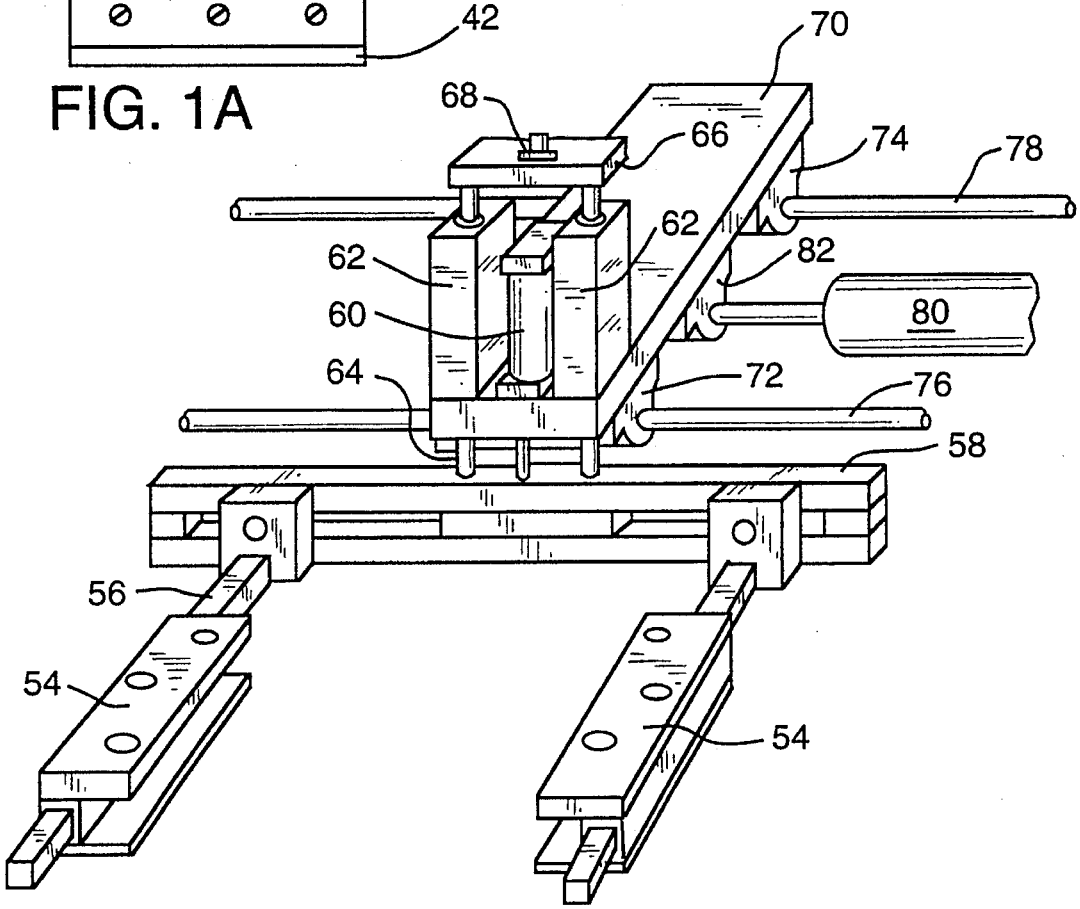
FIG. 1B is a detailed isometric illustration of a silk screen support and drive mechanism.

As shown in FIG. 1A, the squeegee assembly 20 is mounted to a vertically extending arm 30 by fasteners 32 that engage with one of vertically extending guide bushings 34 held in a spaced apart relation by a spacer plate 36. In a space between the guide bushings 34 there is a piston and cylinder assembly 38 having a rod end connected to holder 40 for a squeegee blade 42. Rods 44 extend from the holder 40 internally of the guide bushings 34 to a cross head 46 on which there is threaded mounted an adjusting screw 48 to establish the vertical position of the squeegee blade in a down position for operatively deflecting a silk screen along a line of contact against the surface of the ware. In a manner well known, the silk screen 50 (FIG. 1) is mounted in a rectangular frame 52 that is releasably secured in spaced apart channel members 54 supported by carrier bars 56 as shown in FIG. 1B. The carrier bars can be clamped for support by a carrier 58 that is connected to the rod end of a piston and cylinder assembly 60 for reciprocation between a preestablished down position wherein the screen is in position for printing on ware and an up position where the screen is remotely positioned from the ware during loading, unloading and indexing of the ware.

At opposite lateral sides of the piston cylinder assembly there are guide blocks 62 each for a supporting guide rod 64 that interconnects the carrier 58 with a cross head 66. The cross head carries an adjusting screw 68 to allow selective screen adjustments to the screen for the preestablished down position. The guide blocks 62 and piston and cylinder assembly 60 are mounted on a base 70 which carries first and second sets of linear bearings 72 and 74 that allow the base to slide to and fro along parallel guide rods 76 and 78. Between the guide rods, there is a piston and cylinder assembly 80 that is drivenly connected to the base 70 by a connector 82 to reciprocate the screen back and forth generally between the side walls 12 and 14, the reciprocating motion is used to rotate ware identified in FIG. 1 by reference numeral W while supported on a holder 86.

Figure 3:
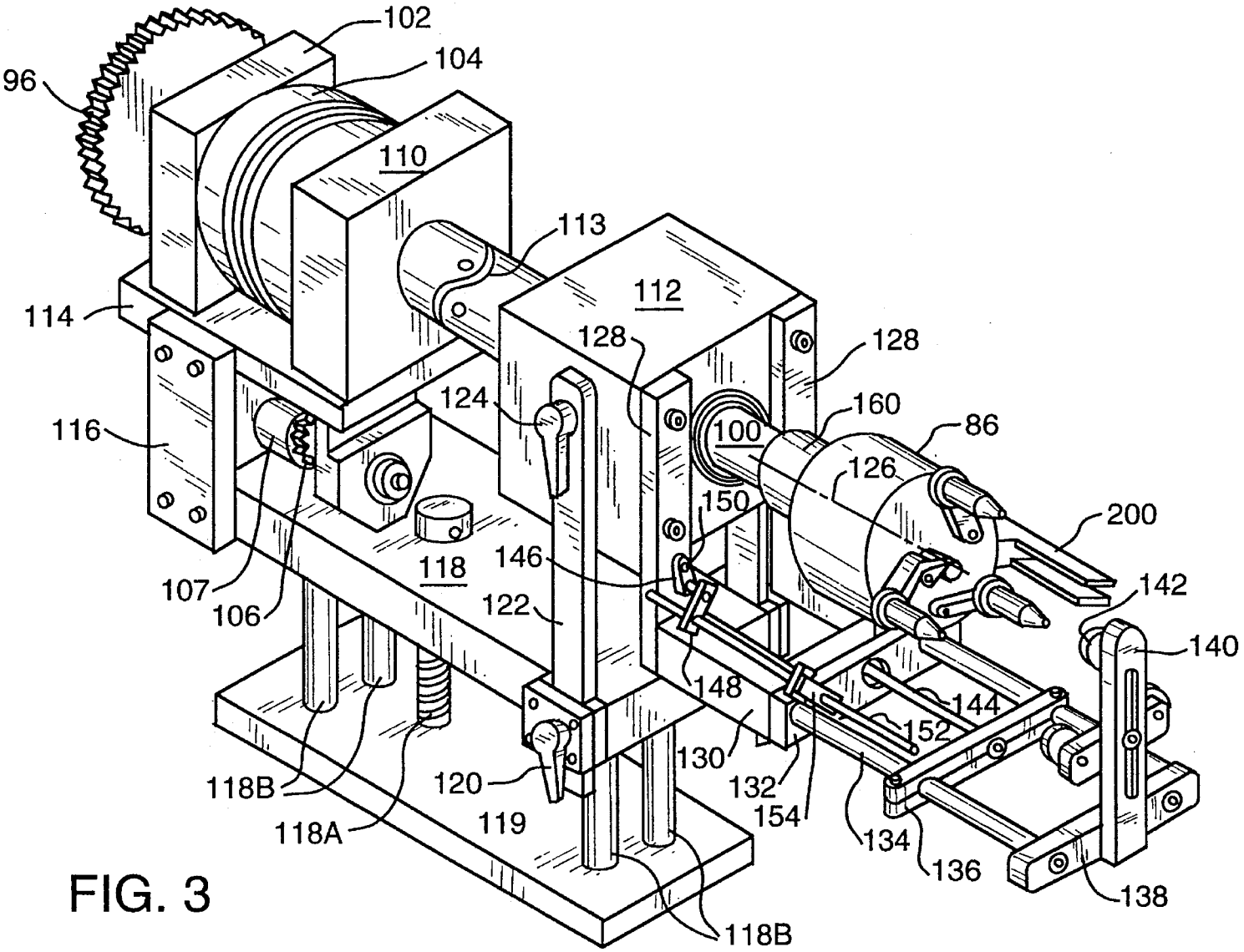
FIG. 3 is an isometric illustration of the holder for ware and its indexing drive controlled by a laser detector assembly of the present invention.

In FIG. 2 there is shown the guide rod 78 and base 70 supported thereby. The end of the base which is opposite piston and cylinder assembly 60 carries a guide block 88 having spaced apart parallel bores for receiving parallel guide rods 90. The upper ends of the guide rods are free to slide in the bores while the lower end of the guide bores are secured to a carrier bar 92 that supports a rack segment 94 continuous meshing with a change gear 96 irrespective of the vertical and reciprocating position is of the silk screen. Reciprocating motion of the rack imparts rotation to the change gear about an axis 98 which extends along a drive shaft 100 connected to holder 86, as best shown in FIG. 3. Drive shaft 100 includes a first portion which extends from change gear 98 through a bearing support block 102 to a clutch 104. When the clutch is disengaged, a second portion of the drive shaft 100 extending from the clutch to the holder 86 is driven by an endless chain 106. The chain extends between a motor shaft of an electric motor 108 (FIG. 2) to a sprocket, not shown, attached to drive shaft 100 between clutch 104 and a bearing support block 110.

Between the bearing support block 110 and a bearing support block 112 there is a length of the drive shaft which can be fitted with a universal joint 113 to allow vertical positioning of support block 112 relative to support blocks 102 and 110. In this regard, support blocks 102 and 110 are rigidly supported by a base 114 which also supports a bearing for the motor shaft of motor 108. The base is joined with mounting blocks 116 at opposite sides which are in turn mounted to a base (not shown) forming part of the printing frame. Base plate 118 extend from mounting blocks 116 to a chuck height adjustment clamp controlled by clamp knob 120 that can raise and lower the elevation at which support block 112 is positioned. For this purpose there extends from clamp 120 vertically orientated arms 122 at opposite sides of the support block 112 which are attached to the support block by pivot handles 124 to accommodate misalignment between an axis 126 about which the holder 86 can rotate and rotational axis 98 of change gear 96 through the utilization of a universal joint 113 (described previously) between support blocks 110 and 112. The elevation of the holder 86 is adjustable by an elevational screw 118A that extends in a parallel relation with guide rods 118B interconnecting base plate 118 with a frame plate 119. Elevational screw 118A is rotated by a hand crank, not shown, to advance the screw through a stationary nut in frame plate 119 and thereby extend and retract the screw bringing about a corresponding change to the elevation of the base plate.

Support block 112 is provided with vertically extending spaced apart carrier arms 128 which are joined at their lower ends with spacer blocks 130 interconnected by a cross arm 132. The spacer blocks 130 and cross arm 132 slideably support spaced apart slide rods 134 which are interconnected by a stop bar 136 and by a carrier bar 138. The carrier bar 138 supports an upstanding pusher plate 140 having a ware support member 142 arranged to move into supporting engagement with the bottom surface of ware, such as a tumbler, while carried by the holder 86. For this purpose, an actuating rod 144 is secured to stop bar 136 and extends to the rod end of a piston and cylinder assembly, not shown, for reciprocating slide rods 134 and thereby moving the support member 142 into and out of support engagement with ware.

Figure 4:
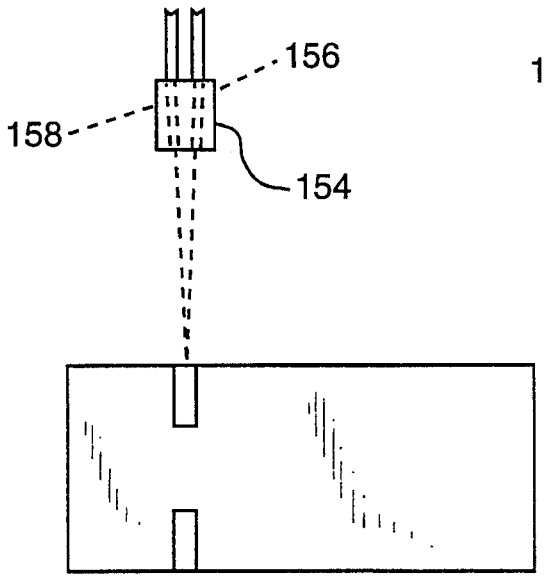
FIG. 4 is a fragmentary illustration of the laser sender/receiver for detecting a reference site on ware.

According to the present invention there is provided structure for directing and receiving a laser beam toward a surface of ware while rotated by holder 86. Such structure includes an articulated support formed by two pivotally interconnected levers 146 and 148. Lever 146 is secured at its free end by a fastener 150 to carrier arm 128. The free end of lever 148 carries an elongated support rod 152 which is distally positioned at one lateral side of the ware by the use of the articulated connection between levers 146 and 148. Rod 152 supports a nozzle 154 containing the terminal end portions of two fiber optic cables 156 and 158, as best shown in FIG. 4, so that radiation by a laser generator remotely situated on the printer frame can be propagated along fiber optic cable 156 and directed toward the surface of a ware W. The nozzle directs the end portion of fiber optic cable 158 for receiving reflected laser beam radiation for transmission thereby to a receiver also located remotely on the machine frame.

The laser beam emitted from fiber optic cable 156 forms an attack angle greater than 90 degrees with a plane tangent with a surface of the ware. This angle is usually not more than, for example, 91 degrees for ensuring that the incident radiation is faithfully returned to the nozzle. The terminal end portions of cables 156 and 158 are side-by-side in the nozzle and can be angularly positioned, one with respect to the other, to insure the faithful recovery of reflected radiation. The nozzle can be remotely positioned from the surface of the ware by a distance of several inches and up to four or five inches, if desired, without degrading the accuracy for detecting an indexing reference site on the ware.

Figure 5:
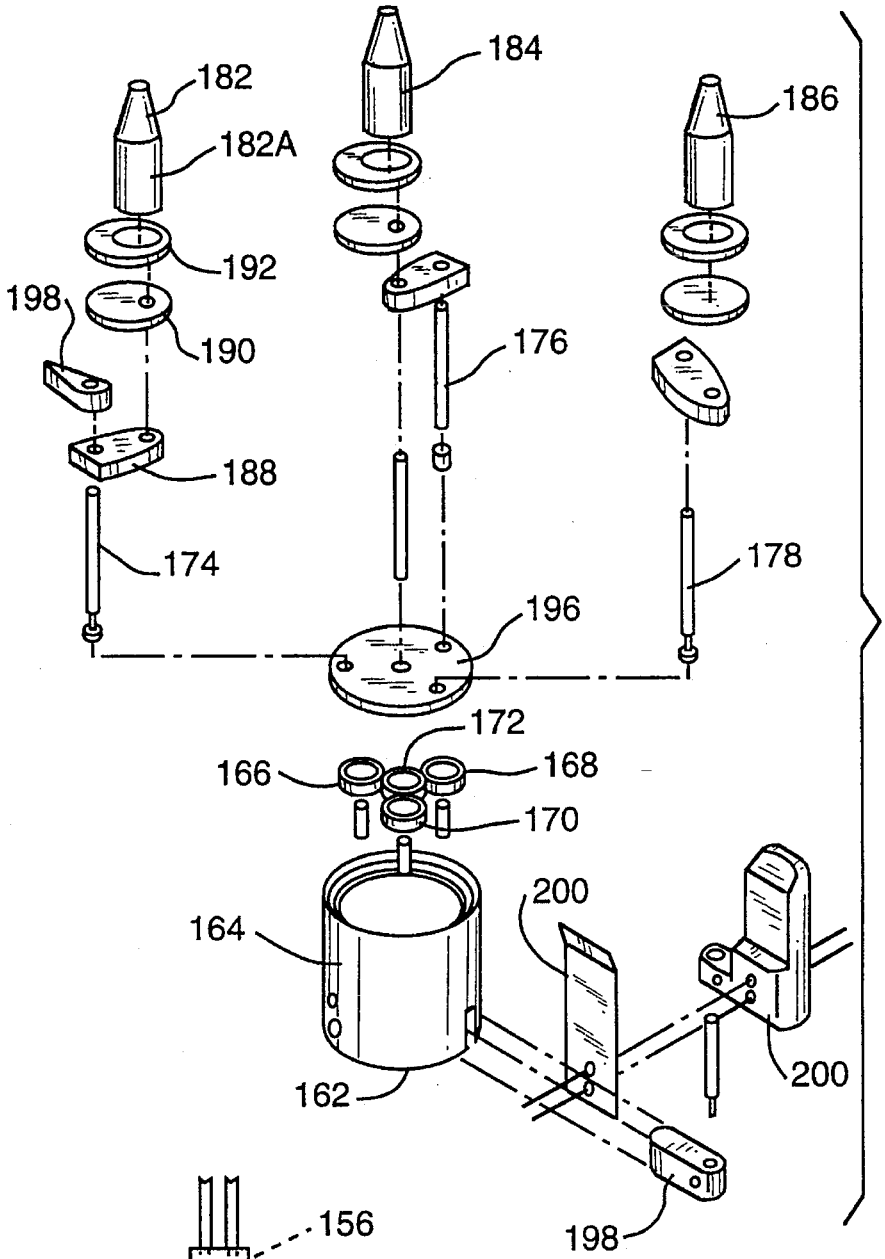
FIG. 5 is an exploded isometric view of a preferred form of holder for ware according to the present invention.

In FIG. 5 there is illustrated a preferred embodiment of a holder for supporting ware for rotation about an axis 126. The shaft 100 includes a collar 160 (FIG. 3) secured to the back wall 162 enclosing one end of a tubular shaped body 164. Supported in the cavity of the body by the back wall is a planetary gear system that includes planetary gears 166, 168 and 170 and a sun gear 172. The planetary gears 166, 168 and 170 drivenly engage with a shafts 174, 176 and 178, respectively, and are connected by springs supported by the tubular body to apply a biasing force to the shafts in a direction causing tapered centering pins 182, 184 and 186 to move radially outward of the tubular body 164. Each centering pin is interconnected with its respective shaft by a pivot arm 188 having one end secured to the shaft and the other end secured to the tapered centering pin. Between the centering pin and the pivot arm there is an eccentric flange 190 and a gasket 192.

A threaded fastener is used to secure centering pins 182 to pivot arm 188 and by loosening this mounting bolt eccentric flange 190 can be positioned to extend radially beyond the cylindrical wall of the ware to provide a plane of support for the ware which is perpendicular to the support afforded by the cylindrical area 182A of the tapered pins. A center pin 194 is used to support the sun gear and extends from a cover plate 196 by a distance so that a tear drop shaped stop block 198 can abut against the end portion of the center pin 194. A threaded fastener is used to interconnect the stop block 198 onto the pivot arm 188 at a position that can be pre-selected to limit the radially outward position of the centering pins 182, 184 and 186 which move in unison because of the planetary gear system by which they are interconnected. Extending from a slot in the side wall of tubular body 164 is a carrier block 198 which in turn supports spaced apart jaws 200 which can receive between the jaws a handle portion of a mug. The use of jaws 200 are an alternative registration means solely for the use of mugs and not part of the present invention. Registration is still necessary for ware in the instance where mechanical means such as the jaws can not be used to establish predetermined relation between existing printing and printing to be newly applied.

Figure 6:
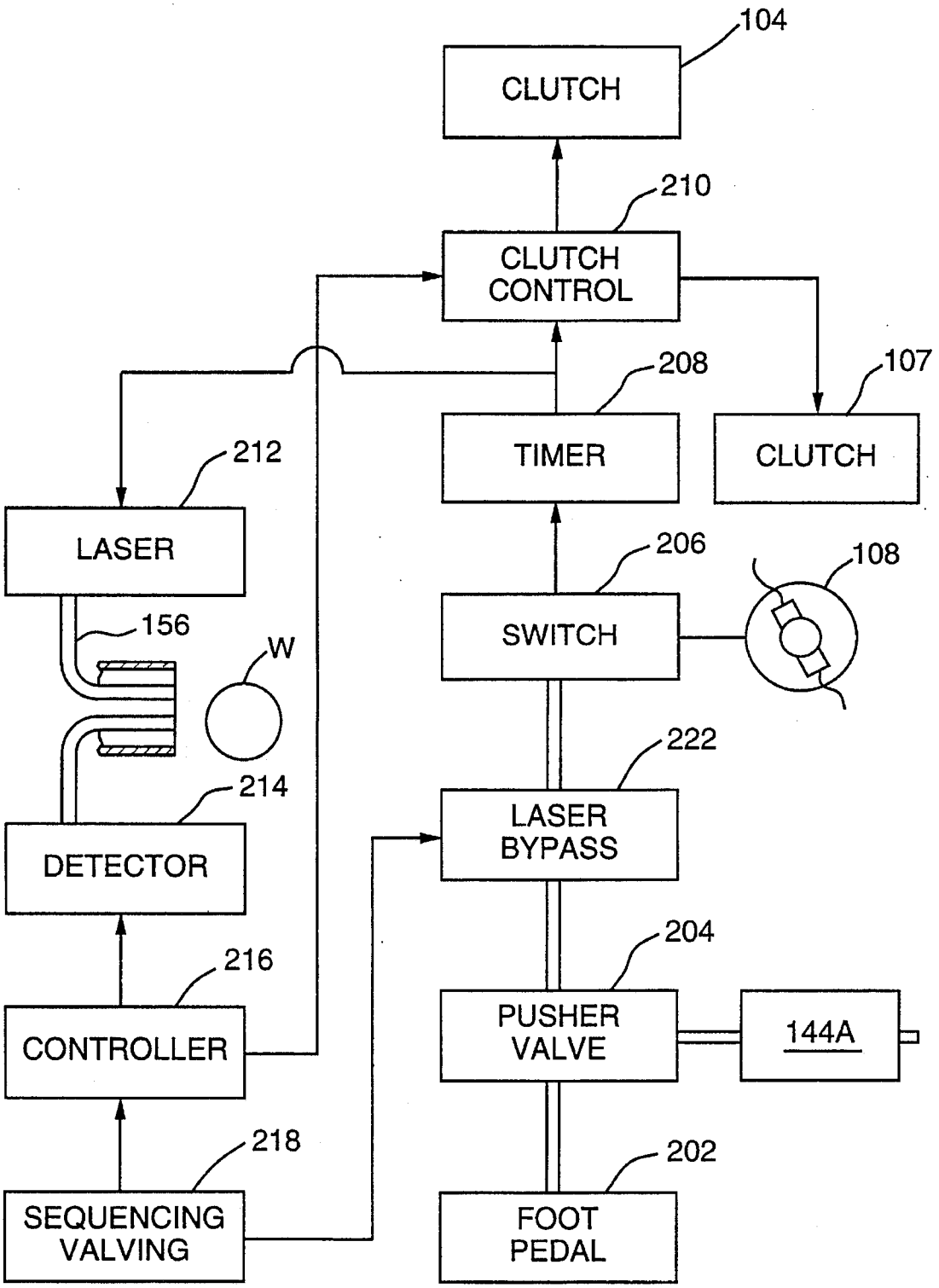
FIG. 6 is a schematic illustration of the electrical pneumatic controls for the semi-automatic printing machine of the present invention.

In FIG. 6 there is illustrated a control circuit which is suitable to carryout the method of the present invention. Once ware has been placed on the holder 86, a foot pedal depressor 202 is actuated by the operators to send an air signal to a pusher valve 204 which applies pneumatic pressure to piston and cylinder assembly 144A which in turn moves rod 144 and causing pusher 140 to move toward the bottom surface of the ware on the holder. At the same time an air signal is sent to an electric switch 206 which provides electrical current to energize motor 108 and an electrical signal to a initiate the counting by a timer 208. The counter introduces a timed delay usually less than one second, to allow the pusher to fully close and engage the ware on the holder. After the timer completes its count cycle, an electrical signal is delivered by the timer 208 to clutch controller 210 which in turn controls clutches 104 and 107 to drivenly disconnect change gear 96 from holder 86 and drivenly engage motor 108 thereby enable rotation of the holder by operation of motor 108. The output signal from the timer 208 also enables a laser generator 212 to emit a laser signal in fiber optic cable 156.

It is important to note that the delay for the operation of the laser 212 insures that operator's hands and other body parts can be distally spaced from the ware as the pusher engages the ware to avoid unnecessary exposure of the operator to the laser. The energy level of the laser is, however, to be selected to avoid any health hazard risk and high energy lasers are unwarranted for the purpose of the present invention. The ware is now rotated by drive motor 108 as the laser beam impinges with the surface of the ware. When the laser is reflected due to impacting with the leading edge of an existing printing or some other preselected indicia, the reflected signal is delivered by fiber optic cable 158 to a detector 214 which in turn delivers an electrical signal to a multi-controller 216. The multi-controller outputs an immediate signal to a clutch controller 210 energizing the clutch 104 thereby coupling together change gear 96 and the non-operating drive system for the screen and squeegee and, at the same time, deenergizing clutch 107 to disengage motor 108 at the same time electrical current is turned OFF to motor 108. Rotation of the ware is brought to an immediate halt with great precision to the position of the indexing reference site relative to the laser beam.

The degree of precision is enhanced by selecting a slow speed for rotation of the ware by the variable speed motor 108. The motor 108 is preferably selected to provide a low torque output which can be disengaged by the clutch 107 at the same time clutch 104 drivenly engages change gear 96 and its relatively massive drive system which remains de-energized until controller 216 delivers an electrical signal to a pneumatic sequencing valving 218 which in turn operates the pneumatic cylinders and drives for the oscillating of the screen and moving the squeegee to complete the printing cycle. When carrying out initial printing on the ware, the pneumatic sequencing valving 218 provides a control signal in line 220 to a laser by-pass circuit 222 situated in the output line of pusher valve 208 extending to switch 206. The laser by-pass circuit 22 disables operation of the laser when energized by the sequencing valve 218.

In view of the foregoing description those skilled in the art will now understand that existing printing can be used to establish an indexing reference site relative to a predetermined printing area. The establishment of the indexing reference site can occur by, for example, upon the loss of a reflected laser signal as well as upon the occurrence of a reception of a reflected laser signal. The loss of a reflected laser signal might typically occur as, for example, a line of printing partially circumscribes the periphery of the ware. The laser will be reflected to the receiver so long as there is impingement with the line of printing. A useful control signal is derived in this instance when the reflected signal ceases caused by the passage of the terminal end of the line of printing beyond the path of the laser beam. Another example where a useful control signal can be generated is an occupance of the reflection of a laser beam at the junction of two different colors, one of which is reflected and the other is not reflective of the laser beam.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An apparatus for indexing ware to receive printing, said apparatus including the combination of:

a holder for supporting ware for rotation about an axis;

means for supporting ware along said axis at a predetermined indexing reference site;

means for rotating said holder about said axis;

a laser including means for directing a laser beam generated thereby toward a surface of ware while rotated by said holder;

a laser detector responsive to reflection of laser radiation incident on a predetermined indexing reference site on the ware; and control means outputting an electrical control signal in response to laser radiation incident on said laser detector for initiating printing on said ware at a predetermined printing area defined relative to said indexing reference site.

2. The apparatus of claim 1 wherein said means for directing a laser beam includes a first fiber optic cable and wherein said apparatus further includes a second fiber optic cable for transmitting the reflection of laser radiation from the indexing reference site to said laser detector.

3. The apparatus of claim 2 further including sheathing to enclose and support said first and second fiber optic cables, and a nozzle for juxta position terminal end portions of said first and second fiber optic cables so that the attack angle of a laser beam emitted by said first fiber optic cable will cause the reflected laser beam to impinge upon the terminal end portion of said second fiber optic cable.

4. The apparatus of claim 1 wherein said means for rotating include a first variable speed drive for rotating ware at a selected variable speed, clutch means responsive to said electrical signal for disengaging said first variable speed drive and engaging a second drive for rotating said ware synchronously with reciprocating of a silk screen for printing on the ware.

5. The apparatus according to claim 1 further including an articulated support for supporting a optical fiber cables for transmitting a laser beam toward the surface of the ware and transmitting a reflected laser beam to said laser detector.

6. The apparatus according to claim 1 wherein said holder includes spring biased centering pins synchronously movable by planetary gears about a sun gear for supporting ware.

7. The apparatus according to claim 6 wherein said holder further includes a flange projecting in a plane perpendicular with a cylindrical surface on each of said centering pins, said plane defining the position of ware along said axis.

8. A method to index ware for printing thereon, said method including the steps of:

supporting the ware at an indexing plane for rotation about an axis perpendicular to said indexing plane;

establishing an indexing reference site on the ware;

directing a laser beam on the ware for intersection by said indexing reference site during rotation of the ware about said axis;

arranging a detector to respond to laser radiation incident on said indexing reference site;

generating an electrical signal in response to laser radiation incident on said detector while rotating the ware about said axis; and applying printing to said ware in response to said electrical signal.

9. The method according to claim 8 wherein said step of establishing an indexing reference site on the ware includes applying a first printing on the ware and selecting a printed edge from the first printing to form said indexing reference site.

10. The method according to claim 8 including the further steps of stopping rotation of said ware in response to said electrical signal at a position for printing on the ware by a printing screen and a squeegee, and synchronously moving the ware and screen for said step of applying the printing.

11. The method according to claim 10 wherein said step of stopping rotation of said ware includes using said electrical signal to energize a clutch for drivenly engaging a non-operating screen drive train.

12. The method according to claim 8 including the further steps of using a first and variable speed drive for selecting a desired speed for rotating the ware about said axis for generating said electrical signal and using a second drive for rotating the ware while printing thereon.

13. The method according to claim 12 including the further step of using a clutch response to said electrical signal to disengage said first variable speed drive, and using a further clutch responsive to said electrical signal to drivenly engage said second drive.

14. The method according to claim 13 wherein said second drive is used as a brake to stop rotation of the ware.

15. The method according to claim 12 including the further steps of turning on said laser at a predetermined timed interval after commencement of rotation of said workpiece about said axis, said predetermined timed interval allowing operators to stand clear of the laser beam.

* * * * *